US008814302B2

(12) United States Patent
Ieiri

(10) Patent No.: US 8,814,302 B2
(45) Date of Patent: Aug. 26, 2014

(54) DEFECTIVE NOZZLE DETECTOR AND IMAGE FORMING APPARATUS AND SYSTEM

(75) Inventor: Yuji Ieiri, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 143 days.

(21) Appl. No.: 13/067,435

(22) Filed: Jun. 1, 2011

(65) Prior Publication Data

US 2011/0298855 A1 Dec. 8, 2011

(30) Foreign Application Priority Data

Jun. 3, 2010 (JP) ..... 2010-128257

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS 5,583,546 A * 12/1996 Balousek ..... 347/19
6,315,383 B1 * 11/2001 Sarmast et al. ..... 347/19
7,789,475 B2 9/2010 Morishita et al.
7,819,492 B2 10/2010 Watanabe et al.
2008/0225070 A1 9/2008 Morishita et al.
2009/0027432 A1 1/2009 Watanabe et al.

FOREIGN PATENT DOCUMENTS

JP 3667134 4/2005
JP 2005280189 A 10/2005
JP 2005280189 A * 10/2005 ..... B41J 2/175

OTHER PUBLICATIONS

Abstract of Japanese Patent Publication No. JP2000-218783, published on Aug. 8, 2000.

* cited by examiner

*Primary Examiner* — Geoffrey Mruk
*Assistant Examiner* — Bradley Thies
(74) *Attorney, Agent, or Firm* — Harness, Dickey & Pierce, P.L.C.

(57) ABSTRACT

A defective nozzle detector is included in an inkjet recording apparatus in which a plurality of nozzles to discharge droplets is provided and a recording head including the plurality of nozzles scans while moving in a main scanning direction, thereby forming an image. The defective nozzle detector includes a sensor board on which droplets are impacted from the nozzle of the recording head, a plurality of sensor electrodes and a common electrode alternately disposed on the sensor board and arranged in patterns that intersect the main scanning direction of the recording head, and an electrostatic capacitance sensor to detect changes in the electrostatic capacitance between the sensor electrode and the common electrode.

8 Claims, 13 Drawing Sheets

DEFECTIVE NOZZLE DETECTOR AND IMAGE FORMING APPARATUS AND SYSTEM

CROSS-REFERENCE TO RELATED APPLICATIONS

The present application claims priority from Japanese patent application number 2010-128257, filed on Jun. 3, 2010, the entire contents of which are incorporated by reference herein.

BACKGROUND OF THE INVENTION

1. Field of the Invention

The present invention relates to a defective nozzle detector, and an image forming apparatus and system incorporating the defective nozzle detector.

2. Description of the Related Art

An inkjet recording apparatus is known as an image forming apparatus, such as a printer, facsimile, copier, plotter, and multifunctional apparatus combining the above functions, that employs a droplet discharge recording method using a recording head to discharge ink droplets used for image formation.

In image forming apparatuses employing the ink droplet discharge recording method, an ink droplet is discharged from a recording head onto a sheet of paper being conveyed to form an image. (Hereinafter, "image formation", "recording", "print", and "printing" mean the same thing and are used interchangeably.) In addition, such apparatuses are of two main types: A serial-type image forming apparatus, in which the recording head discharges droplets to form image while moving in a main scanning direction, and a line-type image forming apparatus, in which the recording head discharges droplets while remaining stationary.

In such an image forming apparatus of droplet discharging method, ink is discharged onto the sheet from a nozzle of the recoding head, to perform recording. Then, when the viscosity of the ink increases due to the evaporation of the solvent in ink or ink solidification, deposition of impurities and/or mixing in of air bubbles may result in the defective ink discharge and decrease in the produced image quality.

To overcome the above problem, an image forming apparatus is disclosed in which a liquid discharge status detecting unit to detect a status of the head discharging the droplet is provided. When a nozzle that is incapable of properly discharging the droplet is detected, a nozzle surface of the head is cleaned, thereby returning the recording head to its proper state.

As a conventional droplet discharge status detecting unit, for example, JP-2005-280189-A discloses an electrostatic capacitance-type detector including a pair of electrodes disposed on a substrate with a predetermined interval in between; a sensor to deposit a droplet discharged from a nozzle of the liquid droplet discharge head located between the pair of electrodes; and detection means to detect a temporary fluctuation in electrostatic capacitance when the liquid droplet is deposited between the sensor electrodes and to detect, based on the temporary fluctuations in electrostatic capacitance, whether the droplet has been discharged from the nozzle or not.

However, the aforementioned electrostatic capacitance-type detector has a disadvantage in that the detection amount of the ink droplet is not stable because the impact of the droplet is detected by the changes in the electrostatic capacitance relative to the electrostatic capacitance before the impact of the droplet, which is used as a reference capacitance, and after the impact of the droplet. Thus, if the shape of the impacted ink droplet does not expand stably on the sensor substrate, the reference detection amount is not stable, and the fluctuation in the electrostatic capacitance by a subsequent droplet impact cannot be detected. This problem is compounded when a head with a number of nozzles such as a line head is used, multiplying the time required by the number of nozzles.

In such a case, the detection time can be shortened by disposing the electrodes in pairs (for example, n-pairs) in line and detecting multiple nozzles simultaneously. However, a disadvantage of this arrangement is that an ink droplet that has impacted around the adjacent electrode pair expands spanning the two adjacent electrode pair lowers the detection accuracy.

To overcome the above disadvantage, the present invention aims to provide a defective nozzle detector that can detect the droplet discharge state in a short period of time and with a higher accuracy.

SUMMARY OF THE INVENTION

Accordingly, the present invention provides a novel defective nozzle detector capable of detecting the state of the nozzle of the recording head in a short period of time and with a higher accuracy.

As an embodiment of the present invention, the defective nozzle detector is included in an inkjet recording apparatus that includes a plurality of nozzles to discharge droplets and a recording head including the plurality of nozzles to scan while moving in a main scanning direction. The defective nozzle detector includes a sensor board on which droplets are impacted from the nozzle of the recording head, a plurality of sensor electrodes and a common electrode alternately disposed on the sensor board and arranged in patterns that intersect the main scanning direction of the recording head, and an electrostatic capacitance sensor to detect changes in the electrostatic capacitance between the sensor electrode and the common electrode.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

In this patent specification, the term "image forming apparatus" means a device for forming an image by impacting ink droplets to media such as paper, thread, fiber, fabric, leather, metals, plastics, glass, wood, ceramics and the like. "Image formation" means not only forming images with letters or figures having meaning to the medium, but also forming images without meaning such as patterns to the medium (and impacting the droplets to the medium). The ink is not limited to so-called ink, but means and is used as an inclusive term for every liquid such as recording liquid, fixing liquid, aqueous fluid, and resins to be used for image formation. "Sheet" is not limited to the paper material, but also includes an OHP sheet and fabrics, on which ink droplets are deposited. The sheet is a collective term for a recorded medium, recording medium, recording sheet, and the like. The image is not limited to a plane two-dimensional one, but also includes a three-dimensional one, and the image formed by three-dimensionally from the 3D figure itself.

Hereinafter, preferred embodiments of the present invention will now be described with reference to drawings.

Figure 1:
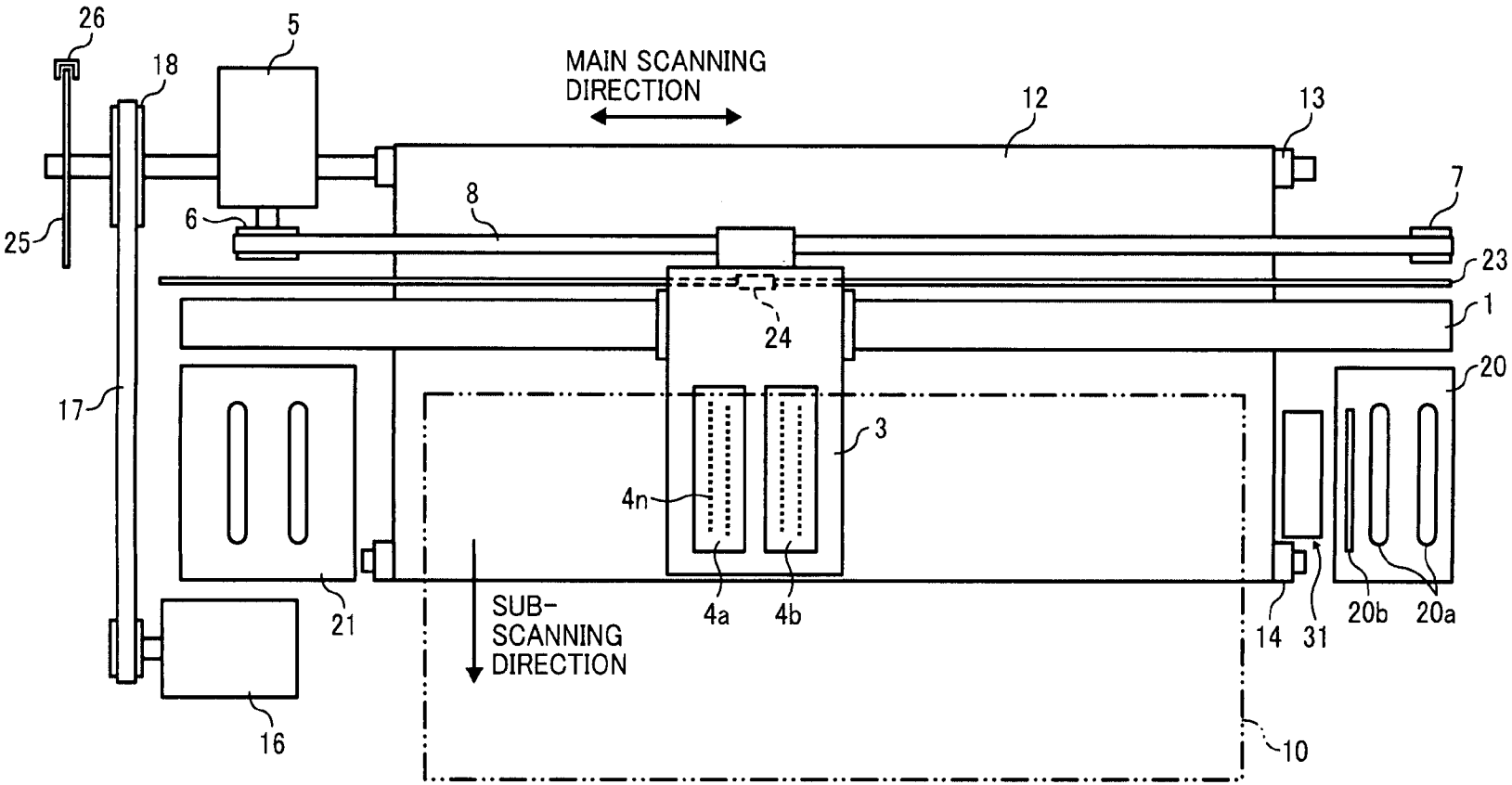
FIG. 1 shows a general configuration of an inkjet recording apparatus as an image forming apparatus according to an embodiment of the present invention.

FIG. 1 is a plan view illustrating a schematic configuration of an inkjet recording apparatus, as an image forming apparatus, to which the present invention is applied. The inkjet recording apparatus includes a main guide rod 1, an auxiliary guide member (not shown), right and left side plates (not shown), a carriage 3, a main scanning motor 5, a driving pulley 6, a driven pulley 7, a timing belt 8, and the like. The main guide rod 1 is laterally held by the side plates. The carriage 3 is slidably held by the main guide rod 1 and the auxiliary guide member and moves in a main scanning direction via the timing belt 8 stretched over the driving pulley 6 and the driven pulley 7 driven by the main motor 5.

The carriage 3 includes recording heads 4*a* and 4*b* (which may be referred to as a recording head 4 when used indiscriminately). Each of the recording heads 4*a* and 4*b* includes nozzles rows 4*n* formed of a plurality of nozzles which are disposed in a sub-scanning direction perpendicular to the main scanning direction, with droplet discharge heads directed downwards.

The recording heads 4 each include two nozzle rows 4*n*. One nozzle row 4*n* of the recording head 4*a* discharges black (K) droplets and the other nozzle row 4*n* of the same discharges cyan (C) droplets. One nozzle row 4*n* of the recording head 4*b* discharges magenta (M) droplets and the other nozzle row 4*n* of the same discharges yellow (Y) droplets.

The droplet discharge head to form the recording heads 4 may employ, as a pressure generation means to generate a pressure to discharge droplets, a piezoelectric actuator using a piezoelectric element, a thermal actuator using an electrothermal transforming device such as a heat generation resistor to use a phase change by film boiling of a liquid, a shape-memory-alloy actuator using metallic phase change, or an electrostatic actuator using the electrostatic force.

Additionally, the inkjet recording apparatus includes a conveyance belt 12, as a conveying means, to convey a sheet 10 by electrostatically adsorbing it toward a position opposite the recording heads 4. The conveyance belt 12 is an endless belt being stretched over a conveyance roller 13 and a tension roller 14 and circulates in the belt conveyance direction (sub-scanning direction) to be electrically charged by a charging roller (not shown) while moving.

In addition, the conveyance belt 12 circulates in the sub-scanning direction because the conveyance roller 13 is driven to rotate via a timing belt 17 and a timing pulley 18 by a sub-scanning motor 16.

The inkjet recording apparatus further includes a maintenance and recovery unit 20 and an blank discharge receiver 21. The maintenance and recovery unit 20 is disposed at one side of the carriage 3 in the main scanning direction and at one side of the conveyance belt 12 and the blank discharge receiver 21 is disposed at the other side of the carriage 3 and the conveyance belt 12. The maintenance and recovery unit 20 includes a cap member 20*a* to cap the nozzle surface of the recording head 4, a wiper 20*b* to clean the nozzle surface, and an blank discharge receiver (not shown) to which droplets not used for image formation are received.

Furthermore, the inkjet recording apparatus includes a defective nozzle detector 31 disposed between the conveyance belt 12 and the maintenance and recovery unit 20.

An encoder scale 23 on which a predetermined pattern is formed is stretched between the both side plates along the main scanning direction of the carriage 3. The carriage 3 includes an encoder sensor 24 formed of a transmission photosensor to read the pattern of the encoder scale 23. The encoder scale 23 and the encoder sensor 24 integrally form a linear encoder to detect movement of the carriage 3 in the main scanning direction.

In addition, a high resolution code wheel 25 is mounted on an axis of the conveyance roller 13, and an encoder sensor 26 which is formed of a transmission photosensor to detect a pattern formed on the code wheel 25 is disposed to the code wheel 25. The code wheel 25 and the encoder sensor 26 together form a rotary encoder to detect displacement and position of the conveyance belt 12 in the sub-scanning direction.

In the thus-formed image forming apparatus, the sheet 10 conveyed from a sheet feed tray (not shown) is fed onto the electrically charged conveyance belt 12, adsorbed thereto, and conveyed in the sub-scanning direction. Then, while the carriage 3 being moved in the main scanning direction, the recording head 4 is driven in accordance with the image signal, and an ink droplet is discharged from the recording head 4 onto the halted sheet 10 to record one line of image. When the sheet 10 is conveyed by a predetermined amount, recording of another line is performed. When the recording ends or when a signal that a trailing edge of the sheet 10 reaches the recording area is received, the recording operation ends and the sheet 10 is discharged onto a sheet discharge tray.

Figure 2:
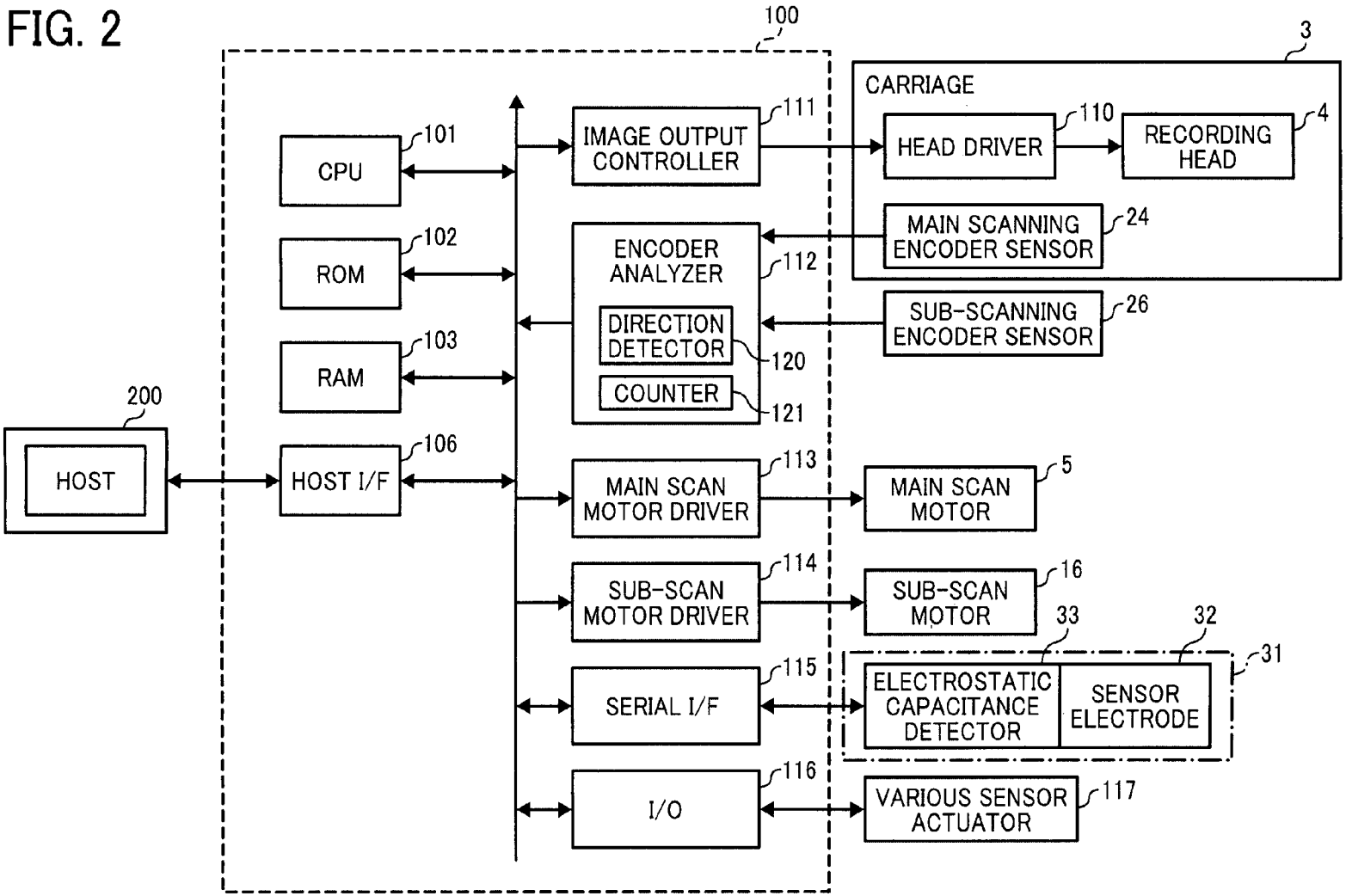
FIG. 2 is a block diagram illustrating an overall view of a controller of the inkjet recording apparatus of FIG. 1.

Next, referring to FIG. 2, a general outline of a controller of this image forming apparatus will be described. FIG. 2 shows a block diagram of the controller 100.

The controller 100 includes a CPU 101 to control the entire apparatus; a ROM 102 to store a program that the CPU 101 performs and other fixed data; a RAM 103 to temporarily store image data and the like; a host or information processor 200 such as a PC; a host interface (I/F) 106 to transfer data between the apparatus and the host 200; an image output controller 111 to drive and control the recording head 4; an encoder analyzer 112 to receive and analyze inputs from the main scan encoder sensor 24 and the sub scan encoder sensor 26; a main scan motor driver 113 to drive the main scanning motor 5; a sub-scanning motor driver 114 to drive the sub scanning motor 16; a serial I/F 115 to connect with the defective nozzle detector 31; and an I/O 116 to connect with various sensors and actuators 117.

The image output controller 111 includes data generation means to form print data; drive pulse generation means to generate a drive pulse to control driving of the recording head 4; data transfer means to transfer a head control signal to select a predetermined drive pulse from the drive pulse and the print data, and the like. A head driver or driver IC 110 is a head drive circuit to drive the recording head 4 which is mounted on the carriage 3. The image output controller 111 outputs the drive pulse, the head control signal, and the print data to the head driver 110, so that the ink droplet is discharged from the nozzle of the recording head 4 in accordance with the print data.

The encoder analyzer 112 includes a direction detector 120 to detect a moving direction from the detection signal, and a counter 121 to detect displacement. The CPU 101 of the controller 100 drives and controls the main scanning motor 5 via the main scanning motor driver 113 based on the analysis result from the encoder analyzer 112, to thereby move the carriage 3, and drives and controls the sub scanning motor 16 via the sub scanning motor driver 114, to thereby convey the sheet 100.

The defective nozzle detector 31 includes a sensor board 32 and an electrostatic capacitance sensor 33. A sensor electrode and a common or ground electrode are formed on the sensor board 32, on which droplets are impacted. The electrostatic capacitance sensor 33 detects variations in the electrostatic capacitance between electrodes of the sensor board 32. The controller 100 moves the recording head 4 when detecting the droplet discharge state or the detective nozzle, to cause a predetermined nozzle to discharge droplet, and detects the droplet discharge state by a detection signal from the defective nozzle detector 31.

Figure 3:
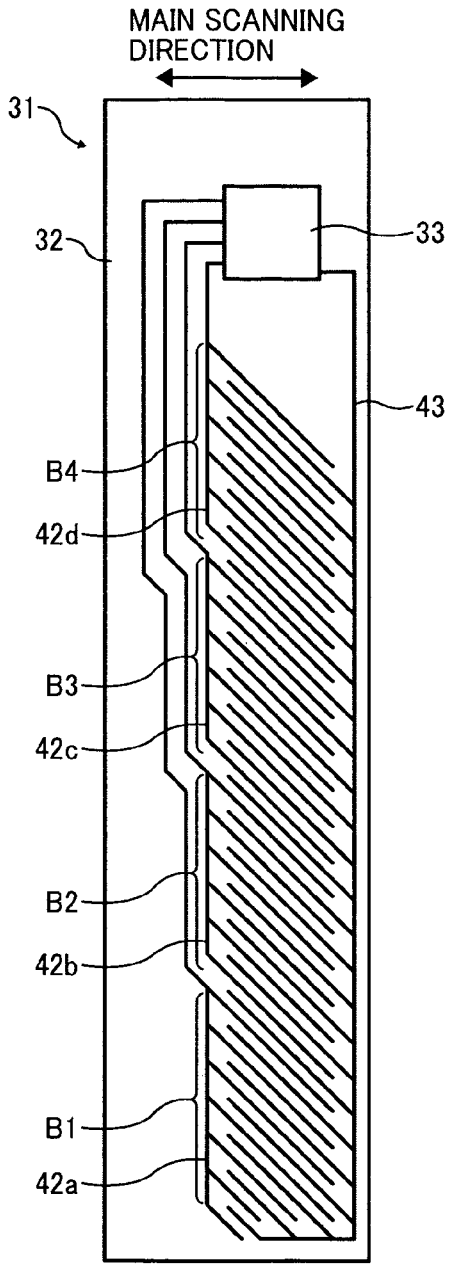
FIG. 3 is an explanatory plan view of a defective nozzle detector according to a first embodiment of the present invention.

Referring to FIG. 3, a detailed description is now given of the defective nozzle detector according to a first embodiment of the present invention. FIG. 3 is a plan view of the defective nozzle detector.

The defective nozzle detector 31 includes a plurality of sensor electrodes 42*a* to 42*d* (which may be referred to collectively as sensor electrode 42) and a ground electrode 43, which are alternately disposed, thereby forming an electrostatic capacitance sensor 33 to detect changes in the electrostatic capacitance between the sensor electrode 42 and the ground electrode 43.

The sensor electrode 42 and the ground electrode 43 in the sensor board 32 each are formed in a come-like pattern disposed alternately in the nozzle arrangement direction, and form fine patterns so that the droplet discharged from the nozzle row 4*n* of the recording head and impacted on any position on the sensor board 32 attaches to both of any of the sensor electrode 42 and any of the ground electrode 43.

The patterns of the sensor electrode 42 and ground electrode 43 are formed so as to intersect the main scanning direction. In this example, the sensor electrode 42 and ground electrode 43 are inclined at an angle of 45 degrees with respect to the main scanning direction.

More specifically, the plurality of sensor electrodes 42*a* to 42*d* is disposed, as the sensor electrode 42, in the nozzle arrangement direction so that a plurality of blocks B1 to B4 are provided in the nozzle arrangement direction. The block B1 includes and is formed of the sensor electrode 42*a* and the ground electrode 43, the block B2 includes the sensor electrode 42*b* and the ground electrode 43, the block B3 includes the sensor electrode 42*c* and the ground electrode 43, and the block B4 includes the sensor electrode 42*d* and the ground electrode 43. Further, the electrostatic capacitance sensor 33 includes, in its interior thereof, a plurality of sensors (in this example, four sensors) respectively connected to the sensor electrodes 42*a* to 42*d*, to detect changes in the electrostatic capacitance.

As described above, because the sensor electrode 42 is divided into a plurality of blocks B1 to B4 each including one of the sensor electrodes 42*a* to 42*d* in the nozzle arrangement direction and each block B1 to B4 includes the corresponding electrostatic capacitance change sensor, droplets can be simultaneously discharged from nozzles of each area of the nozzle row 4*n* corresponding to each block B1 to B4 and the time to detect a defective nozzle as to all nozzles in one nozzle row can be reduced.

Figure 4:
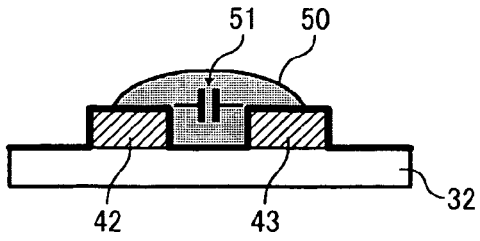
FIG. 4 is an enlarged view of a part including a sensor electrode and a common or ground electrode adjacent to each other.

Referring next to FIG. 4, the principle behind detection of the droplet discharge state by the electrostatic capacitance detection will be described. FIG. 4 is an enlarged view of a part including a sensor electrode and a ground electrode adjacent to each other.

Electrostatic capacitance can be obtained by measuring the electrostatic capacitance generated between the sensor electrode 42 connected to the electrostatic capacitance sensor 33 and the ground electrode 43 adjacent to the sensor electrode 42. The detected electrostatic capacitance is determined by the dielectric constant of the substance existing in the space between the sensor electrode 42 and the ground electrode 43 and the space surrounding them. Accordingly, if the sensor electrode 42 and the ground electrode 43 are in the atmosphere, the electrostatic capacitance based on the dielectric constant of the air can be detected, and if the both are covered by aqueous droplets, the electrostatic capacitance based on the dielectric constant of the water can be detected.

Accordingly, as illustrated in FIG. 4, when a droplet 50 impacts the sensor electrode 42 and the ground electrode 43, the electrostatic capacitance by the dielectric constant of the droplet or ink droplet 50 can be detected as schematically shown by the mark of a condenser 51. Thus, when the droplet discharged from the nozzle impacts as illustrated in FIG. 4, the electrostatic capacitance between the sensor electrode 42 and the ground electrode 43 changes, and the electrostatic capacitance sensor 33 can detect existence or nonexistence of the impact of the droplet. That is, a state in which a droplet is not discharged from the nozzle, that is, which in this case is equivalent to a defective nozzle, can be detected.

In the present embodiment, the detection target is not limited to a substance that contacts the electrode, but includes a space surrounding the electrodes. Specifically, even though the droplets impact consecutively, variations in the dielectric constant of the apace can be detected by the new droplets, unless previous impacts of droplet cause agglomeration or an abundant droplet covers the sensor board 32.

Figure 5A:
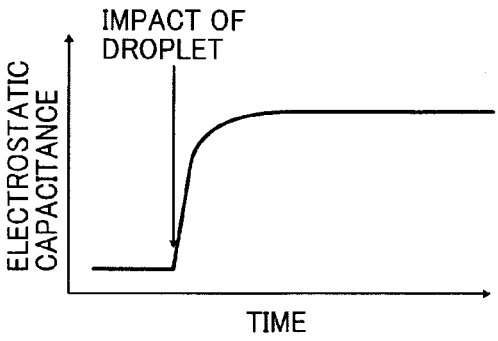
FIGS. 5A and 5B are views illustrating a detection amount of an electrostatic capacitance sensor.

Referring next to FIGS. 5A and 5VB, a detection amount by the electrostatic capacitance sensor will now be described.

When a droplet impacts between the sensor electrode 42 and the ground electrode 43 of the sensor board 32, the electrostatic capacitance between the both electrodes 42 and 43 varies schematically as illustrated in FIG. 5A. However, the detection amount of the electrostatic capacitance is affected by environmental conditions such as temperature and moisture, nearby liquid, and the like. Then, it is difficult to detect existence or nonexistence of the detection target by applying an absolute value as a threshold value to the detected electrostatic capacitance.

Figure 5B:
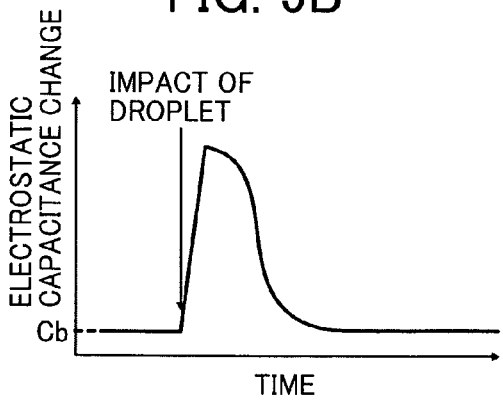

Then, in general, as illustrated in FIG. 5B, an operation to extract a varied amount (or change) in the electrostatic capacitance from the obtained electrostatic capacitance is performed, and the existence or nonexistence of the detection target is obtained by comparing the change with the threshold value. With this operation, the effect of the environmental conditions can be negated. In this case, however, unless the baseline or reference value Cb can be determined in the less-changeable state, the following detection cannot be performed.

In particular, when detecting the change in the electrostatic capacitance as illustrated in FIG. 4, because the impacted droplet remains on the sensor board 32 and expends gradually, it takes several tens to hundreds of milliseconds until the baseline Cb is stabilized and the next detection can be performed. Then, if the detection of failure for all nozzles from several hundreds to thousands of the recording head is performed sequentially one by one, it takes a very long time until completion of the detection of all nozzles.

Figure 6:
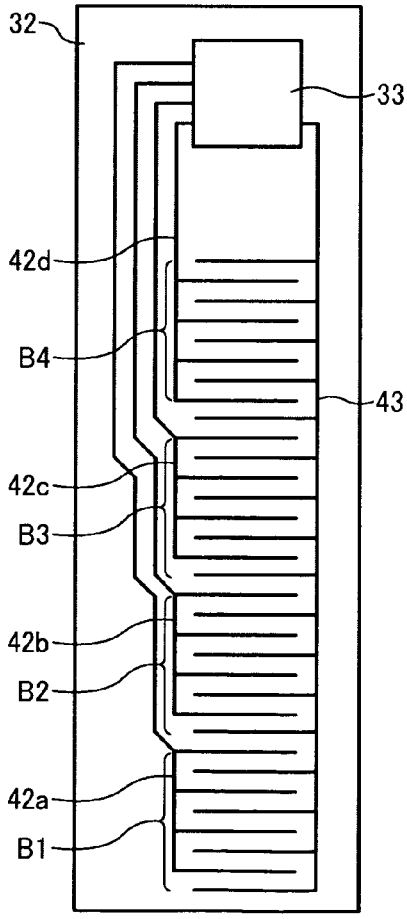
FIG. 6 is a plan view of a comparative example of the defective nozzle detector.

To facilitate an understanding of the effects of the defective nozzle detector according to the present embodiment, a comparative example of the defective nozzle detector will be described with reference to FIG. 6. FIG. 6 is a plan view of the comparative example of the defective nozzle detector.

This comparative example is different from the first embodiment of the present invention in that electrode patterns of the sensor electrodes 42*a* to 42*d* and ground electrode 43 (electrode patterns of each block B1 to B4) are arranged parallel to the main scanning direction of the recording head 4.

When detecting defective nozzles using the defective nozzle detector according to this comparative example, as illustrated in FIG. 7 (A), discharging from the nozzles of nozzle row 4*n* of the recording head 4 is so controlled as to correspond to the blocks B1 to B4 of the sensor electrode 42 of the sensor board 32. Specifically, the recording head 4 is controlled to discharge droplets 50 from one nozzle from each of the blocks B1 to B4, and from total 4 nozzles from the blocks B1 to B4 simultaneously.

Figure 7A:
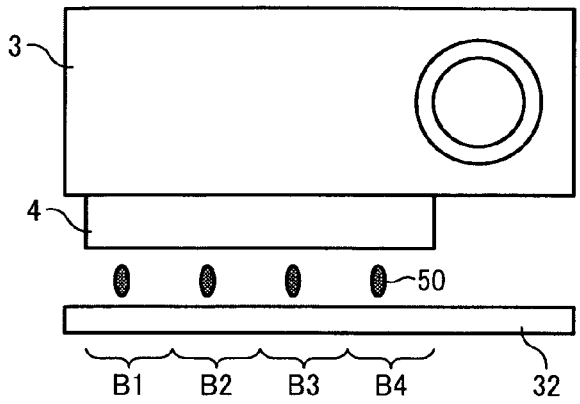
FIGS. 7A and 7B each are views illustrating droplet discharge state detection near the center of the block related to the comparative example shown in FIG. 6.
Figure 7B:
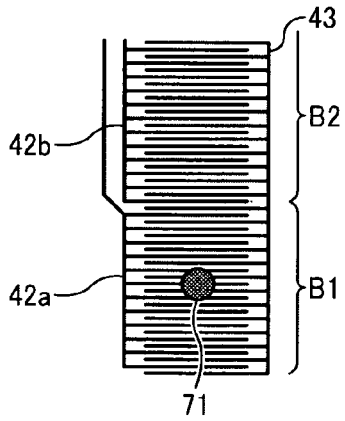
Figure 7C:
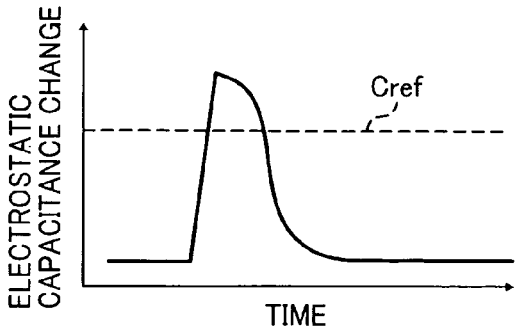
FIG. 7C is a graph illustrating a detected amount of impact of the droplet as compared to a threshold value, related to a comparative example.

FIG. 7A shows a case in which droplets 50 are discharged from nozzles positioned near the center of each block. As illustrated in FIG. 7B, an expanded circle 71 of the droplet 50 impacted on the sensor board 32 is positioned within each of the blocks B1 to B4. Accordingly, as illustrated in FIG. 7C, by comparing the detection amount by the impact of the droplet 50 with the threshold value Cref, it is determined that there is an impact of droplet (that is, normal discharge) when the detection amount exceeds the threshold value Cref. Also, it is determined that there is no impact of droplet (that is, defective discharge or defective nozzle) when the detection amount is below the threshold value Cref.

Thus, the defective nozzle among the plurality of nozzles can be detected simultaneously, detection time can be reduced comparing to the case in which defective nozzle is determined by causing each nozzle to discharge a droplet.

Figure 8A:
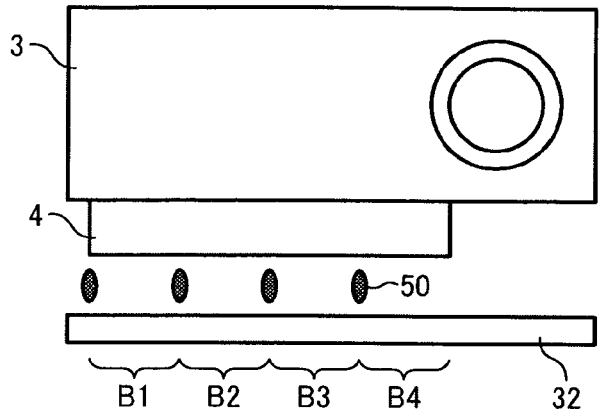
FIGS. 8A-8C are views illustrating droplet discharge state detection near the boundary between the blocks related to the comparative example.
Figure 8B:
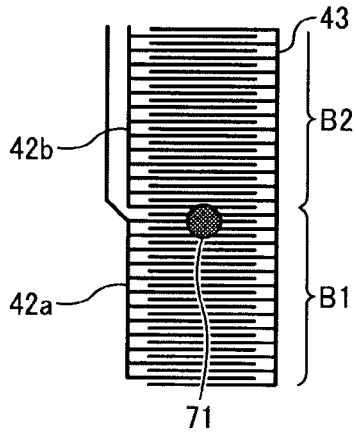
Figure 8C:
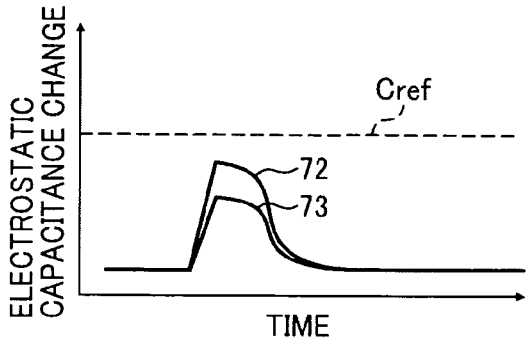

And now, as illustrated in FIG. 8A, when droplets 50 are discharged from nozzles positioned around the boundary of each of the blocks B1 to B4, the circle 71 impacted on the sensor board 32 and expanded on the surface of the sensor board 32 crosses over the boundary of adjacent blocks as illustrated in FIG. 8B. Then, as detection outputs 72 and 73 represent in FIG. 8C, two electrostatic capacitance changes are obtained. Because both the detection outputs 72 and 73 do not exceed the threshold value Cref being a reference in determining existence or nonexistence of the impact of droplet, it is determined that the defective nozzle exists.

As described above, if the sensor electrode 42 and ground electrode 43 of the sensor board 32 are arranged parallel to the main scanning direction of the head 4 as in the comparative example, when two or more defective nozzles among the plurality of nozzles are to be detected simultaneously by dividing the nozzles of the nozzle rows into a plurality of blocks, because the electrostatic capacitance change amount (detection output) of the nozzle near the boundary of the blocks is lower than that of the nozzle near the block center, the defective nozzle cannot be detected normally and erroneous detection may occur.

By contrast, in the defective nozzle detector according to the present invention, electrode patterns of the sensor electrode 42 and the ground electrode 43 on the sensor board 32 intersect the main scanning direction. Accordingly, when two or more defective nozzles among the plurality of nozzles are to be detected by dividing the electrode patterns into a plurality of blocks, defective nozzles can be correctly detected even though the droplet exists near the boundary of the blocks.

An example of droplet discharge state detection operation according to the defective nozzle detector of the present invention will now be described with reference to FIGS. 9A and 9B, each of which is a plan view illustrating a main part of the sensor board 32.

Figure 9A:
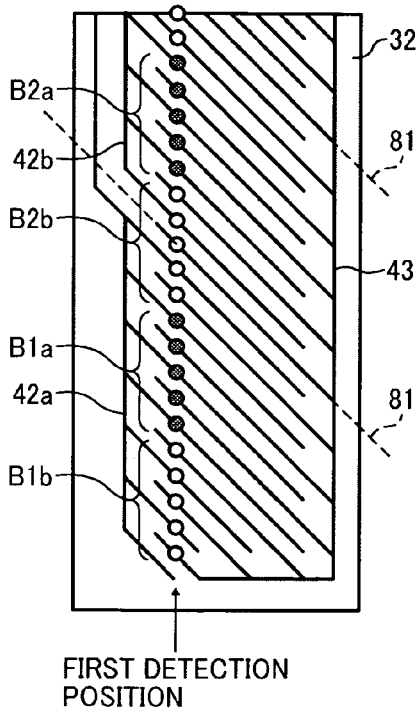
FIGS. 9A and 9B are views illustrating a droplet discharge state detection operation in the first embodiment of the present invention.
Figure 9B:
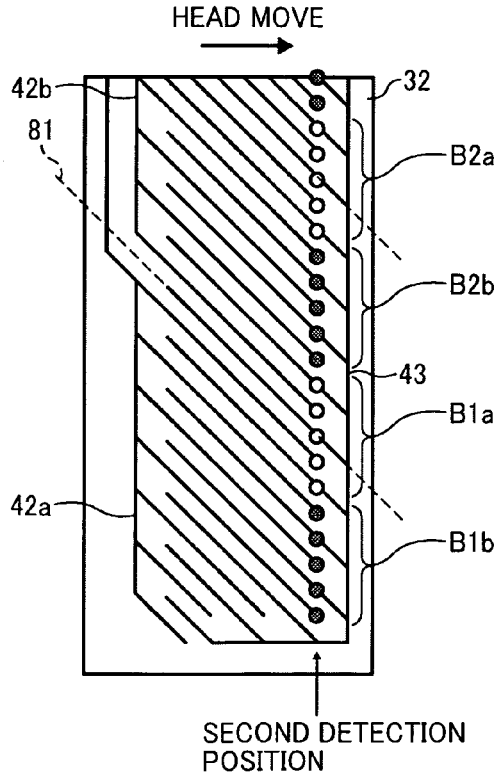

As illustrated in FIGS. 9A and 9B, the electrode patterns of the sensor electrode 42 and the ground electrode 43 are arranged with an inclination of 45 degrees with respect to the main scanning direction. In this case, a boundary between blocks of the sensor electrode 42 resides at a position along a line 81. In addition, in detecting the defective nozzle, the nozzle discharge control blocks are further divided into two. For example, the sensor electrode 42*a* is further divided by two and the block B1 is divided into two blocks, such as B1*a* and B1*b*. FIGS. 9A and 9B show a part corresponding to two blocks of the sensor electrode 42, in which white circles show non-discharging nozzles and black dots show discharging nozzles or discharged droplets.

First, the recording head 4 is placed at a first detection position in the main scanning direction of FIG. 9A and is caused to discharge droplets from nozzles corresponding to the blocks B1*a* and B2*a*, thereby detecting a defective nozzle. In this case, the nozzles corresponding to the blocks B1*b* and B2*b* are controlled not to discharge droplets, that is, defective nozzle detection is not performed. Then, any droplet is not discharged to the boundary between blocks, that is, the position along the line 81.

Next, the recording head 4 is moved in the main scanning direction up to a second detection position in the main scanning direction of FIG. 9B, and is caused to discharge droplets from nozzles corresponding to the blocks Bib and B2*b*, thereby detecting a defective nozzle. In this case, any droplet is not discharged to the boundary between blocks, that is, the position along the line 81.

Accordingly, the droplet does not simultaneously cross over the boundary between the two electrodes, that is, the boundary between one sensor electrode 42 and two ground electrodes 43 or two sensor electrodes 42 and one ground electrode 43. Then, the existence or nonexistence of impact of droplets (or defective nozzles) can be detected as to all nozzles avoiding discharging of the droplets to the boundaries between blocks of the sensor electrode 42.

Figure 10:
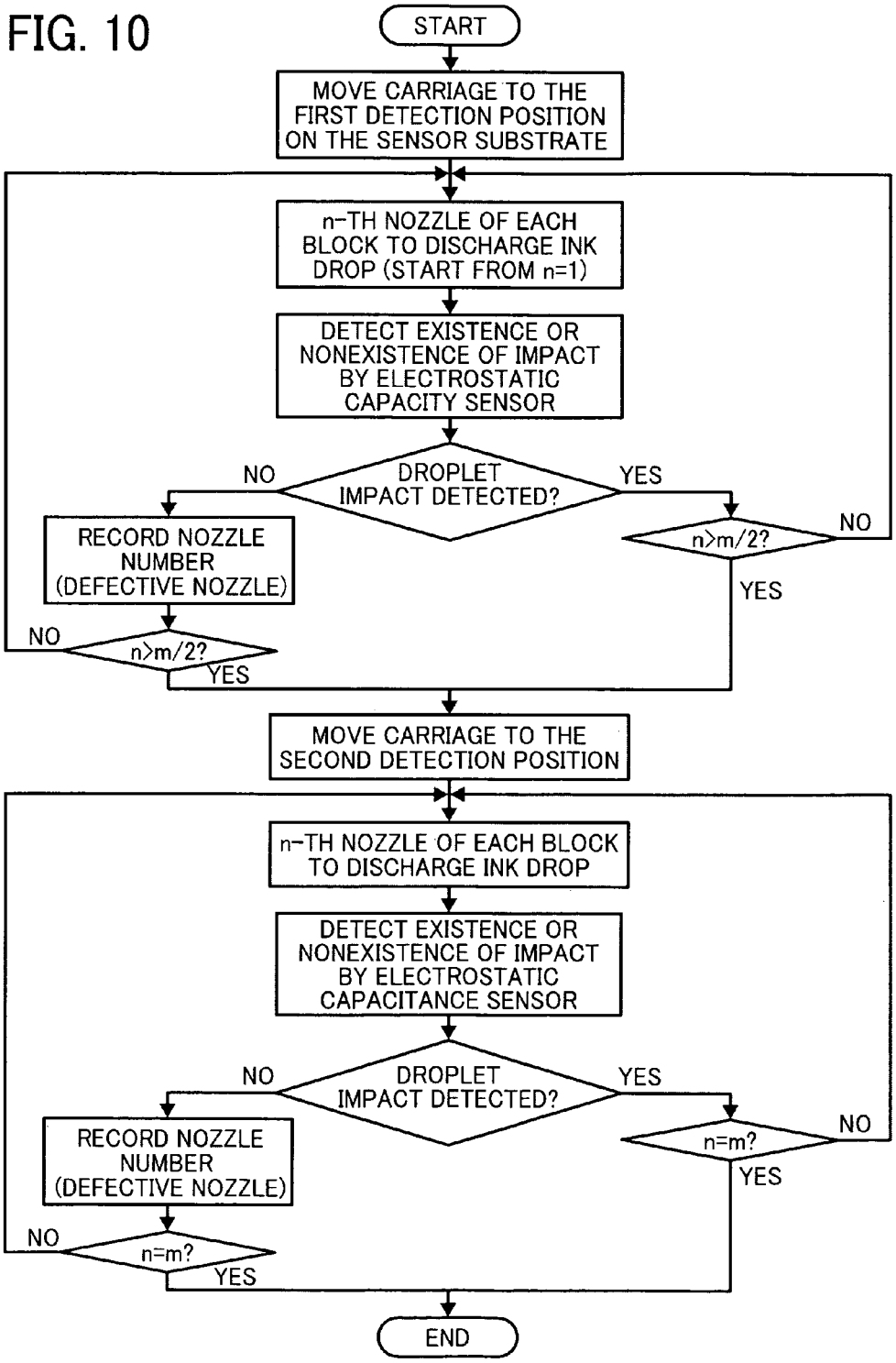
FIG. 10 is a flowchart illustrating the droplet discharge state detection operation.

FIG. 10 is a flowchart illustrating steps in the droplet discharge state detection operation. The CPU 101 of the controller 100 starts to execute this droplet discharge state detection operation (which is stored as a program in the ROM) upon receiving an instruction to execute the droplet discharge state detection operation from the host 200, or at a timing to start the droplet discharge state detection operation previously set in the image forming apparatus.

Herein, the number of nozzles corresponding to one block of the sensor electrode 42 is set to m (m=10 in the example of FIG. 9), and the nozzle discharge to detect defective nozzles is controlled with one half block as a unit.

First, the carriage 3 (or the recording head 4) is moved to the first detection position on the sensor board 32 (for example, the first position in FIG. 9(A)), and droplets are discharged from an n-th nozzle in each unit block. (Operation starts from n=1.) Then, existence or nonexistence of impact of droplets is detected by the electrostatic capacitance sensor 33.

When there is an impact of droplet, it is determined whether n>(m/2) or not. If the determination is not n>(m/2), that is, if it is not determined whether the impact of droplet concerning the nozzles more than a half of one block being a unit block exists or not, the detection target nozzle n is incremented to n+1, and the process returns to an operation to discharge droplets from the next (n+1)th nozzle.

When there is no impact of droplet, the nozzle number of the detection target nozzle which gives a droplet discharge instruction of no impact is recorded as a defective nozzle, the detection target nozzle n is incremented to n+1, and the process returns to an operation to discharge droplets from the next (n+1)th nozzle. (Herein, the nozzle number is set to be a consecutive specific number to each nozzle in one nozzle row.)

After the detection of defective nozzles has been completed as to the nozzles in one half block (the unit block), the carriage 3 (or the recording head 4) is moved to the second detection position on the sensor board 32 (see FIG. 9 (B)), and droplets are discharged from the n-th nozzles of another half block (the unit block).

Then, the electrostatic capacitance sensor 33 detects existence or nonexistence of the impact of droplets. When there is an impact of droplet, the detection target nozzle n is incremented to n+1. When there is no impact of droplet, the nozzle number is recorded as a defective nozzle, and the detection target nozzle n is incremented to n+1 and defective nozzle detection is performed as to all nozzles in the remaining half unit block. After the completion of defective nozzle detection for all nozzles, the droplet discharge state detection operation ends.

The defective nozzle detector according to the first embodiment includes a plurality of sensor electrodes and a common or ground electrode which are alternately arranged and an electrostatic capacitance sensor to detect changes in the electrostatic capacitance between the sensor electrode and the common electrode. In the defective nozzle detector, electrode patterns of the sensor electrode and the common electrode intersect the main scanning direction of the recording head. Accordingly, when the nozzle rows are divided into a plurality of blocks and the droplets are discharged from two or more nozzles simultaneously to detect the droplet discharge state, erroneous detection in the boundary of blocks is prevented and the droplet discharge state can be detected in a short period of time with higher precision.

Next, another example of the droplet discharge state detection operation or defective nozzle detection operation according to a second embodiment of the present invention will now be described with reference to FIG. 11, which is a plan view illustrating a main part of the sensor board 32.

In the second embodiment, while the recording head 4 is being moved, the detection target nozzle is sequentially changed to detect defective nozzles, thereby moving the droplet impact position of each nozzle onto the sensor board 32 in the main scanning direction.

Figure 11:
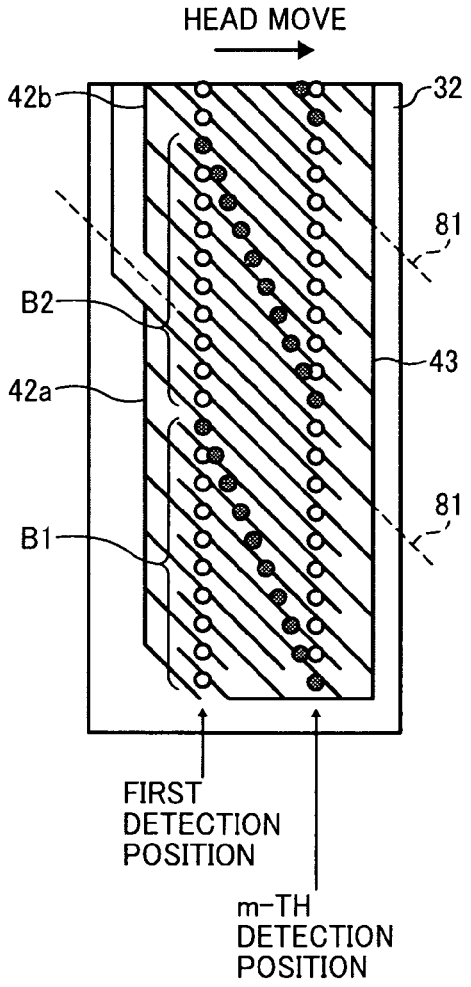
FIG. 11 is a plan view illustrating a main part of a sensor board according to a second embodiment of the present invention.

As illustrated in FIG. 11, the nozzle discharge control block is set to be one block of the sensor electrode 42 differently from the first embodiment. There are m number of nozzles in one block. From the first detection position to the m-th position (m=2 to m), droplets are discharged from one nozzle in each block while moving the recording head 4.

Specifically, the droplet impacted on the sensor board 32 remains at the impacted position unless it is removed by any means. When the next discharge is so performed as to overlay the previously impacted position, the detection amount of the electrostatic capacitance may be reduced. Then, by continuously discharging droplets while moving the recording head 4 to detect defective nozzles, the distance between the impacted positions can be elongated compared to a case in which droplets are discharged from adjacent nozzles simultaneously, and the reduction in the detection amount due to the overlapped impacts of the droplets can be reduced.

Figure 12:
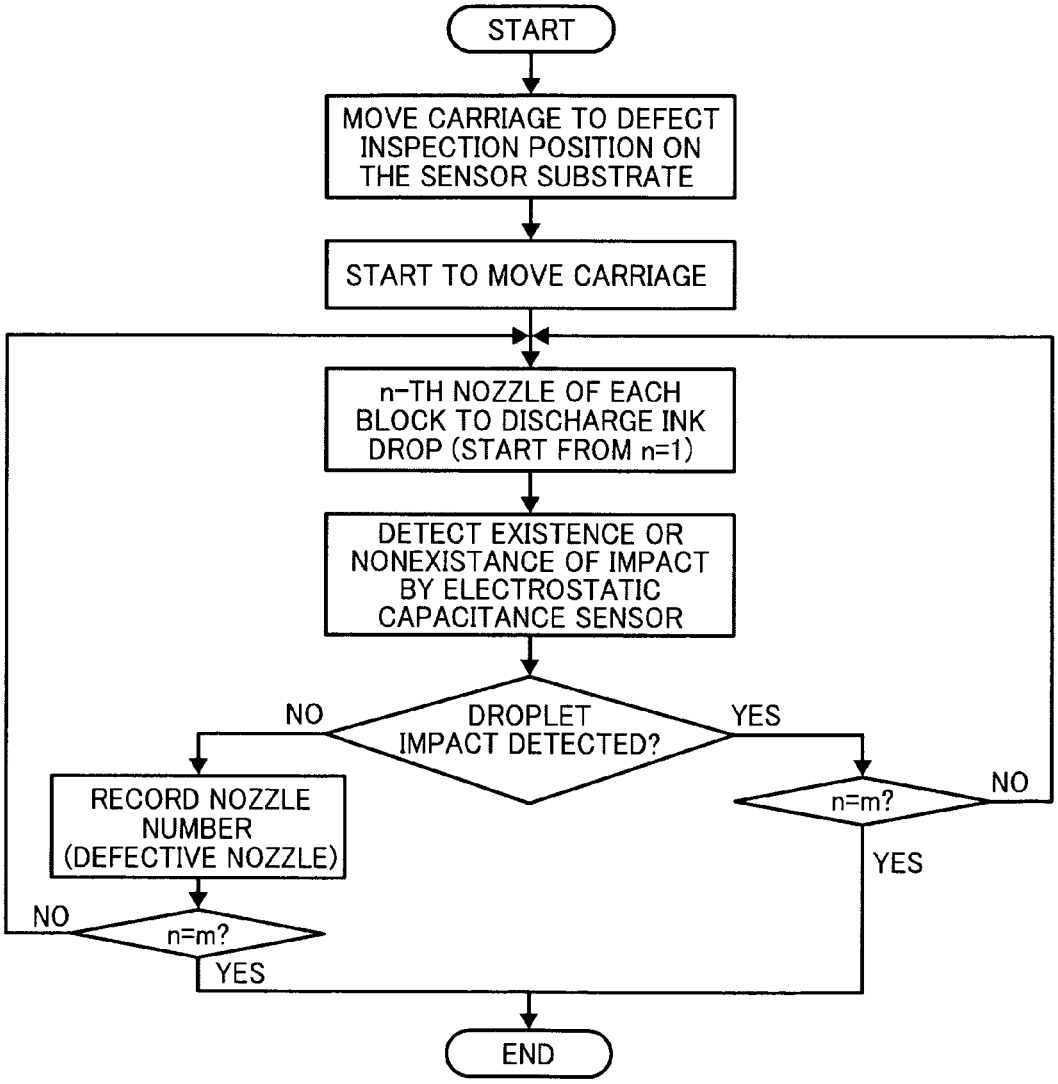
FIG. 12 is a flowchart illustrating a droplet discharge state detection operation of the second embodiment.

FIG. 12 is a flowchart illustrating the droplet discharge state detection operation of the second embodiment.

The CPU 101 of the controller 100 starts to execute this droplet discharge state detection operation (which is stored in the ROM) upon receiving an instruction to execute the droplet discharge state detection operation from the host 200, or at a timing to start the droplet discharge state detection operation previously set in the image forming apparatus.

First, the carriage 3 (or the recording head 4) is moved to the first detection position on the sensor board 32, the carriage 3 starts to move at a predetermined speed, and droplets are discharged from an n-th nozzle in each block. (Operation starts from n=1.) Then, existence or nonexistence of impact of droplets is detected by the electrostatic capacitance sensor 33.

When there is an impact of droplet, it is determined whether n=m or not. If the determination is not n=m, that is, if it is not determined whether the impact of droplet concerning all the nozzles in one block exists or not, the detection target nozzle n is incremented to n+1, and process returns to an operation to discharge droplets from the next (n+1)th nozzle.

By contrast, when there is no impact of droplet, the nozzle number of the detection target nozzle which gives a droplet discharge instruction of no impact is recorded as a defective nozzle, the detection target nozzle n is incremented to n+1, and the process returns to an operation to discharge droplets from the next (n+1)th nozzle.

After the completion of detection of defective nozzles as to all nozzles in one block, the droplet discharge state detection operation is completed.

Figure 13:
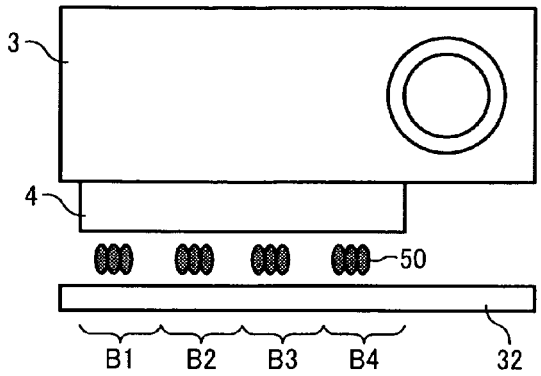
FIG. 13 is a view illustrating droplet discharge state detection according to a third embodiment.
Figure 14:
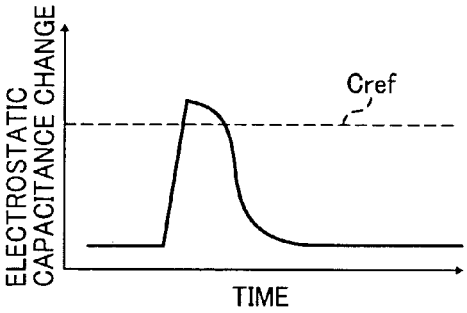
FIG. 14 is a graph illustrating changes in the electrostatic capacitance in the normal state.
Figure 15:
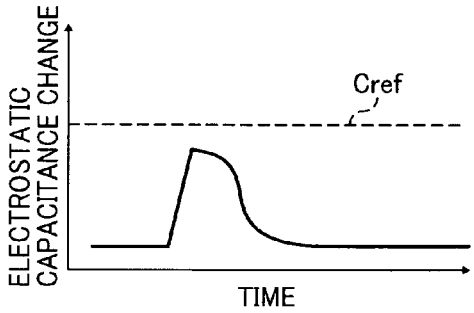
FIG. 15 is a graph illustrating changes in the electrostatic capacitance in a case in which a defective nozzle is detected.

Next, as to the droplet discharge state detection operation or defective nozzle detection operation according to a third embodiment of the present invention will now be described with reference to FIGS. 13 to 15. FIG. 13 is a view of the droplet discharge state detection according to the third embodiment. FIG. 14 is a graph illustrating changes in the electrostatic capacitance in the normal state and FIG. 15 is a graph illustrating changes in the electrostatic capacitance in a case in which a defective nozzle is detected.

The third embodiment shows a case in which droplets are discharged from two or more nozzles in one block simultaneously, thereby detecting a defective nozzle.

For example, as illustrated in FIG. 13, when droplets are discharged from three nozzles in each block simultaneously, if all three nozzles normally discharge droplets, the detection output of the electrostatic capacitance change exceeds the threshold value Cref as illustrated in FIG. 14. By contrast, if one nozzle among three does not discharge droplets and the remaining two nozzles normally discharge droplets, the detection output of the electrostatic capacitance change falls below the threshold value Cref as illustrated in FIG. 15, whereby it is detected that one of the nozzles is defective.

In the above case, which of the three nozzles is defective is not detected; however, when the existence of the defective nozzle is detected, the unit of nozzle row or recording head itself can be subjected to nozzle recovery or cleaning operation and there is no problem even though the exact defective nozzle is not specifically identified.

Thus, the time required for the droplet discharge state detection operation can be reduced compared to the first and second embodiments in which existence or nonexistence of the defection is determined for each nozzle.

Figure 16:
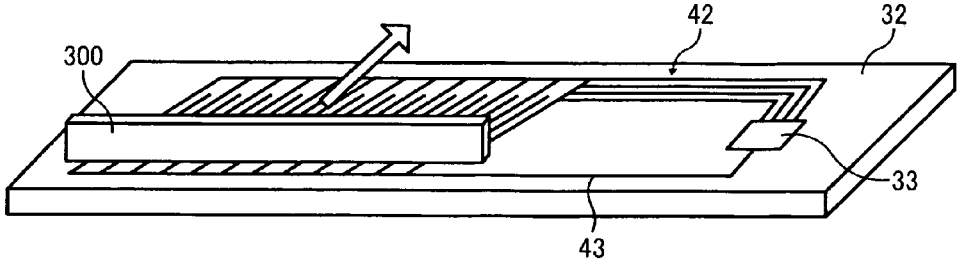
FIG. 16 is an oblique view according to a fourth embodiment.
Figure 17:
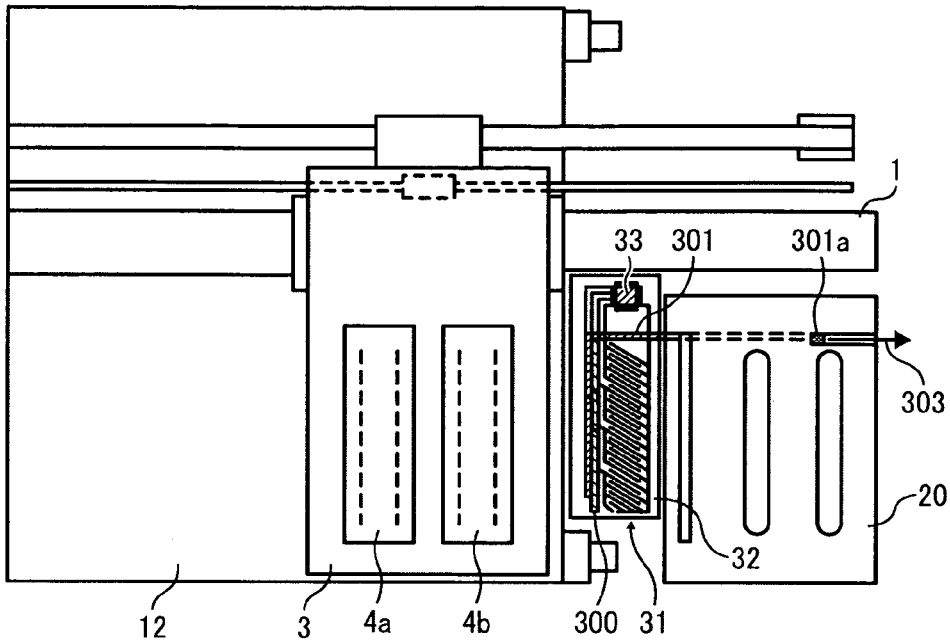
FIG. 17 is a plan view illustrating a main part of a moving unit of a wiper according to the fourth embodiment.

Next, a fourth embodiment of the present invention will now be described with reference to FIGS. 16 and 17. FIG. 16 is an oblique view according to a fourth embodiment. FIG. 17 is a plan view illustrating a main part of a moving unit of a wiper according to the fourth embodiment.

In the fourth embodiment, as illustrated in FIG. 16, a wiper 300 to clean the surface of the sensor board 32 is provided.

Specifically, the droplets impacted on the sensor board 32 remain thereon unless they are removed by some means. Moisture is lost from the surface of the remaining droplets as time elapses, and the droplets are finally solidified. The residue accumulated on the sensor board 32 may result in the reduction of detection sensitivity of the electrostatic capacitance.

Then, the surface of the sensor board 32 is wiped off by the wiper 300 formed of a rubber blade and the like, thereby removing the accumulated droplets, recovering the detection sensitivity and enabling detection with higher accuracy over a long period of time.

As illustrated in FIG. 17, the moving unit of the wiper 300 includes a lever 301 disposed on the wiper 300, and a projection 301*a* disposed on the lever 301 and engageable with the carriage 3. When the carriage moves to an end of the main scanning direction, the protrusion 301*a* is pushed toward an arrow 303 direction by the move of the carriage 3, and the wiper 300 moves on the sensor board 32 to remove the residue.

By disposition of such a wiper, the sensor board 32 remains clean without any actuator means.

Figure 18:
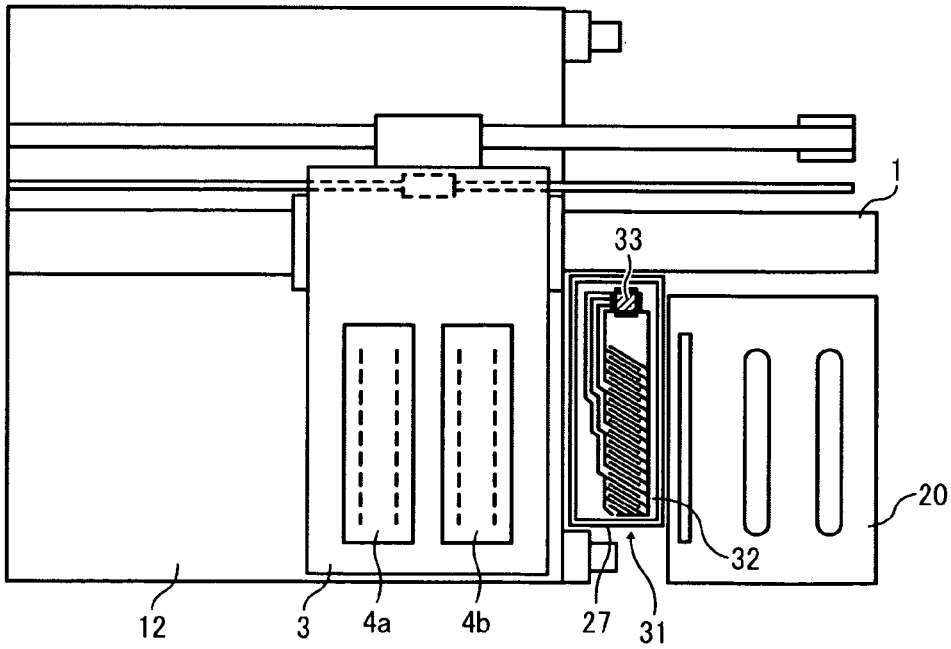
FIG. 18 is a plan view of an blank discharge receiver according to a fifth embodiment.
Figure 19:
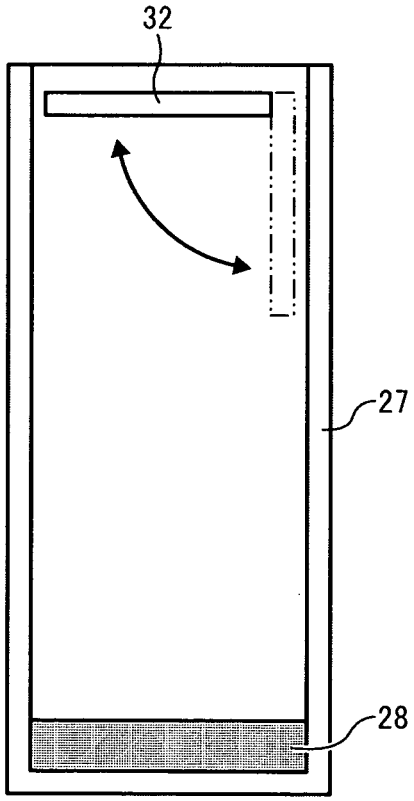
FIG. 19 is a cross-sectional view illustrating the blank discharge receiver of FIG. 18.

Next, a fifth embodiment of the present invention will now be described with reference to FIGS. 18 and 19. FIG. 18 is an explanatory plan view of a blank discharge receiver according to the fifth embodiment. FIG. 19 is a cross-sectional view illustrating the blank discharge receiver.

In the fifth embodiment, a blank discharge receiver 27 to receive blank discharge droplets not contributive to image formation, is provided between the conveyance belt 12 and the maintenance and recovery unit 20. The blank discharge receiver 27 includes an opening at its upper part thereof, and an absorbing member 28 on its bottom.

The sensor board 32 is disposed at the opening of the blank discharge receiver 27 movably between a detection position as illustrated in a solid line and a retracted position as illustrated in a dotted line of FIG. 19. The move of the sensor board 32 is performed by an actuator means, not shown.

As configured as above, the range of the carriage 3 moving in the main scanning direction can be reduced. Specifically, the sensor board 32 needs to be disposed below the scanning range of the carriage 3, and the conveyance means such as a conveyance belt 12, the maintenance and recovery unit 20, and the blank discharge receiver 27 need to be disposed in the main scanning direction, which elongates the main scanning range of the carriage and enlarges the outer shape of the apparatus.

Then, as described above, the blank discharge receiver 27, which is required only in the blank discharge operation, and the defective nozzle detector 31 share the main scanning direction area. When performing defective nozzle detection, the sensor board 32 is uplifted to be horizontal (or is moved to the detection position as illustrated in the solid line), and is rotated to be stored (or moved to the retracted position as illustrated in the dotted line) when the defective nozzle detection is not performed, thereby minimizing the main scanning range of the carriage 3 and preventing the entire apparatus from becoming large.

The aforementioned droplet discharge state detection operation can be stored as a program that can be installed in the ROM of the controller, and the program is executed by the computer. Alternatively, the program can be supplied in the form of a recording medium or by downloading directly from a network such as the Internet.

Additional modifications and variations of the present invention are possible in light of the above teachings. It is therefore to be understood that, within the scope of the appended claims, the invention may be practiced other than as specifically described herein.

What is claimed is:

1. A defective nozzle detector included in an inkjet recording apparatus including a plurality of nozzles to discharge droplets and a recording head that moves to scan in a main scanning direction and includes the plurality of nozzles, the defective nozzle detector comprising:

a sensor board on which droplets are impacted from the nozzles of the recording head;

a plurality of sensor electrodes and a common electrode alternately disposed on the sensor board in patterns that intersect with respect to the main scanning direction of the recording head;

each of the sensor electrodes having a first linear electrode extending in a sub-scanning direction perpendicular to the main scanning direction, and a second linear electrode extending without being bent in a direction in which the second linear electrode intersects at an inclination angle of 45 degrees with respect to the main scanning direction, one end of the second linear electrode being connected to the first linear electrode of the sensor electrode, the common electrode has a third linear electrode extending in a direction parallel to the first linear electrode of the sensor electrode, and a fourth linear electrode extending without being bent in the direction in which the fourth linear electrode intersects at the inclination angle of 45 degrees with respect to the main scanning direction, one end of the fourth linear electrode being connected to the third linear electrode of the common electrode, and the second linear electrodes of the sensor electrodes and the fourth linear electrodes of the common electrodes being disposed facing each other; and an electrostatic capacitance sensor to detect changes in electrostatic capacitance between the plurality of sensor electrodes and the common electrode, wherein the plurality of sensor electrodes is disposed in a nozzle arrangement direction such that a plurality of blocks is provided in the nozzle arrangement direction, wherein one block of the of the sensor electrode is divided into two parts of a first detection position and a second detection position, whereby after moving the recording head to the first detection position, the detection of the defective nozzle is performed by discharging droplets on one part of the block, and after moving the recording head to the second detecting position, detection of the defective nozzle is performed by discharging droplets on the other part of the block.

2. The defective nozzle detector as claimed in claim 1, wherein the plurality of sensor electrodes on the sensor board are divided into a plurality of blocks, and an electrostatic capacitance sensor is provided to each block.

3. The defective nozzle detector as claimed in claim 1, wherein the droplets are discharged to the sensor board from the nozzle of the recording head by moving the head between two positions in the main scanning direction.

4. The defective nozzle detector as claimed in claim 1, wherein the droplets are discharged to the sensor board from the nozzle of the recording head while the head is being moved to scan in a main scanning direction.

5. The defective nozzle detector as claimed in claim 1, wherein droplets are discharged from two or more nozzles simultaneously.

6. The defective nozzle detector as claimed in claim 1, further comprising a wiper to wipe and clean the sensor board.

7. An image forming apparatus, comprising:

a defective nozzle detector included in an inkjet recording apparatus including a plurality of nozzles to discharge droplets and a recording head that moves to scan in a main scanning direction and includes the plurality of nozzles, the defective nozzle detector including:

a sensor board on which droplets are impacted from the nozzles of the recording head;

a plurality of sensor electrodes and a common electrode alternately disposed on the sensor board in patterns that intersect with respect to-the main scanning direction of the recording head;

each of the sensor electrodes having a first linear electrode extending in a sub-scanning direction perpendicular to the main scanning direction, and a second linear electrode extending without being bent in a direction in which the second linear electrode intersects at an inclination angle of 45 degrees with respect to the main scanning direction, one end of the second linear electrode being connected to the first linear electrode of the sensor electrode, the common electrode has a third linear electrode extending in a direction parallel to the first linear electrode of the sensor electrode, and a fourth linear electrode extending without being bent in the direction in which the fourth linear electrode intersects at the inclination angle of 45 degrees with respect to the main scanning direction, one end of the fourth linear electrode being connected to the third linear electrode of the common electrode, and the second linear electrodes of the sensor electrodes and the fourth linear electrodes of the common electrodes being disposed facing each other; and an electrostatic capacitance sensor to detect changes in electrostatic capacitance between the plurality of sensor electrodes and the common electrode, wherein the plurality of sensor electrodes is disposed in a nozzle arrangement direction such that a plurality of blocks is provided in the nozzle arrangement direction, wherein one block of the of the sensor electrode is divided into two parts of a first detection position and a second detection position, whereby after moving the recording head to the first detection position, the detection of the defective nozzle is performed by discharging droplets on one part of the block, and after moving the recording head to the second detecting position, detection of the defective nozzle is performed by discharging droplets on the other part of the block.

8. An image forming system, comprising:

an image forming apparatus, the image forming apparatus including:

a defective nozzle detector included in an inkjet recording apparatus including a plurality of nozzles to discharge droplets and a recording head that moves to scan in a main scanning direction and includes the plurality of nozzles, the defective nozzle detector including:

a sensor board on which droplets are impacted from the nozzles of the recording head;

a plurality of sensor electrodes and a common electrode alternately disposed on the sensor board in patterns that intersect with respect to the main scanning direction of the recording head;

each of the sensor electrodes having a first linear electrode extending in a sub-scanning direction perpendicular to the main scanning direction, and a second linear electrode extending without being bent in a direction in which the second linear electrode intersects at an inclination angle of 45 degrees with respect to the main scanning direction, one end of the second linear electrode being connected to the first linear electrode of the sensor electrode, the common electrode has a third linear electrode extending in a direction parallel to the first linear electrode of the sensor electrode, and a fourth linear electrode extending without being bent in the direction in which the fourth linear electrode intersects at the inclination angle of 45 degrees with respect to the main scanning direction, one end of the fourth linear electrode being connected to the third linear electrode of the common electrode, and the second linear electrodes of the sensor electrodes and the fourth linear electrodes of the common electrodes being disposed facing each other;

an electrostatic capacitance sensor to detect changes in electrostatic capacitance between the plurality of sensor electrodes and the common electrode; and a processor to instruct the image forming apparatus to perform the droplet discharge state detection, wherein the plurality of sensor electrodes is disposed in a nozzle arrangement direction such that a plurality of blocks is provided in the nozzle arrangement direction, wherein one block of the of the sensor electrode is divided into two parts of a first detection position and a second detection position, whereby after moving the recording head to the first detection position, the detection of the defective nozzle is performed by discharging droplets on one part of the block, and after moving the recording head to the second detecting position, detection of the defective nozzle is performed by discharging droplets on the other part of the block.

* * * * *